US005187039A

United States Patent [19]

Meyer

[11] Patent Number: 5,187,039

[45] Date of Patent: Feb. 16, 1993

[54] IMAGING MEMBER HAVING ROUGHENED SURFACE

[75] Inventor: Robert J. Meyer, Penfield, N.Y.

[73] Assignee: Xerox Corporation, Stamford, Conn.

[21] Appl. No.: 560,875

[22] Filed: Jul. 31, 1990

[51] Int. Cl.[5] ..... G03G 13/16

[52] U.S. Cl. ..... 430/126; 430/120; 355/259; 355/299

[58] Field of Search ..... 430/125, 56, 57, 58, 430/59, 126; 355/259, 299

[56] References Cited

U.S. PATENT DOCUMENTS

| | | | |
|---|---|---|---|
| 3,121,006 | 2/1964 | Middleton et al. | 96/1 |
| 3,357,989 | 12/1967 | Bryne et al. | 260/314 |
| 3,442,781 | 5/1969 | Weinberger | 204/181 |
| 3,992,091 | 11/1976 | Fisher | 156/292 |
| 4,076,564 | 2/1978 | Fisher | 156/292 |
| 4,134,763 | 1/1979 | Fujimura et al. | 96/1.5 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,415,639 | 11/1983 | Horgan | 430/57 |
| 4,469,771 | 9/1984 | Hasegawa et al. | 430/126 |
| 4,587,189 | 5/1986 | Hor et al. | 430/59 |
| 4,588,666 | 5/1986 | Stolka et al. | 430/59 |
| 4,615,963 | 10/1986 | Matsumoto et al. | 430/56 |
| 4,690,544 | 9/1987 | Forbes et al. | 430/125 |
| 4,693,951 | 9/1987 | Takasu et al. | 430/31 |
| 4,739,370 | 4/1988 | Yoshida et al. | 430/125 |
| 4,764,448 | 8/1988 | Yoshitomi et al. | 430/120 |
| 4,804,607 | 2/1989 | Atsumi | 430/67 |
| 4,904,557 | 2/1990 | Kubo | 430/56 |
| 4,912,000 | 3/1990 | Kumakura et al. | 430/67 |

FOREIGN PATENT DOCUMENTS 53-92133 8/1978 Japan .

OTHER PUBLICATIONS

Velarde and Normand, "Convection", Scientific Amer., 243, 92 (1980).

*Primary Examiner*—John Goodrow

*Attorney, Agent, or Firm*—Oliff & Berridge

[57] ABSTRACT

An imaging system and method are provided using an imaging member having a surface roughness which prevents the adhesion of toner particles, especially flat toner particles, during blade cleaning. The surface roughness is preferably defined by $$R/a_{nn}^4 > \frac{K_B(1-\sigma^2)}{32\pi E t^2 a_f}$$

and $$R/a_{nn}^2 < \frac{\sqrt{3}}{8\pi^2}\ \frac{1+\mu^2}{\mu}\ \frac{K_B}{\Gamma}\ \frac{t}{a_f}\ \theta$$

wherein R is an average height of asperities of said surface, $a_{nn}$ is one-half the nearest neighbor distance between said asperities on said surface, $K_B$ is bulk modulus of the blade, $\sigma$ is Poisson's ratio of the toner composition, E is Young's modulus of the toner composition, t is an average thickness of flat particles in said toner composition, $a_f$ is an average radius of the flat particles, $\mu$ is an average of toner-blade and toner-surface friction coefficients, $\Gamma$ is the Dupré work of adhesion between the surface and the flat particles, and $\theta$ is blade tip angle. The particular surface roughness prevents toner particles from developing a high surface energy on the imaging member surface.

In another embodiment of the invention, the above boundaries defining the surface roughness are further limited to a particular asperity height. The height is chosen such that small particles, such as additives, become easily cleanable by a blade.

18 Claims, 2 Drawing Sheets

IMAGING MEMBER HAVING ROUGHENED SURFACE

BACKGROUND OF THE INVENTION

This invention relates in general to electrostatographic imaging, and preferably, to an imaging member having a roughened surface.

In electrostatography, an imaging member containing an insulating layer on a conductive layer is imaged by first uniformly electrostatically charging its surface. The plate is then exposed to a pattern of activating electromagnetic radiation such as light. The radiation selectively dissipates the charge in certain areas of the insulating layer while leaving behind an electrostatic latent image in the other areas. This electrostatic latent image may then be developed to form a visible image by depositing finely divided electroscopic marking particles (toner) on the surface of the insulating layer. The resulting visible image may then be transferred from the imaging member to a support such as paper. This imaging process may be repeated many times with reusable insulating layers. It is necessary to clean residual toner from the surface of the insulating layer prior to repeating another imaging cycle.

One common method of cleaning is blade cleaning. Elastomer blade cleaning of imaging members is conceptually simple and economical, but raises reliability concerns in mid- and high-volume applications due to apparent random failures. Such random failures justify the reluctance to include blade cleaners in higher volume machines with or without some back-up element.

Alternative cleaning techniques used in higher volume applications include the use of magnetic, insulative and electrostatic brushes. However, such cleaning techniques are also subject to specific or timed failures. These failures include, but are not limited to, photoreceptor filming and permanent impaction of toner particles and toner fragments. Specific failures may, in part, be related to the materials package, e.g., the toner and any additives contained with the toner. These types of blade and cleaning failures can be quite reproducible.

One random failure mode of a cleaning blade may be due to inherent variations or flaws in the material of the blade, which allow stresses and strains with extended copying to locally fatigue the edge of the blade. An additional random failure mode can be local or image related enhancements or reductions in blade/-photoreceptor friction which cause unacceptably large tuck-under of a doctor blade edge. A large enough tuck or break in the blade/photoreceptor seal can permit residual toner and other debris to pass under the blade resulting in streaks on the copy. This not only decreases cleaning efficiency, for example by increasing background, but in severe cases can result in catastrophic system failure.

A number of methods have been implemented or proposed to enhance blade/photoreceptor contact properties. One method includes agitation of the blade against the photoreceptor to prevent build-up of material along the contact seal. Another method includes addition of redundant members, such as disturber brushes to loosen or collect debris which might otherwise stress the blade element. These methods increase the mechanical complexity and the cost of the cleaning assembly, and are thus undesirable.

Another method for enhancing blade/photoreceptor contact properties includes the addition of lubricants to the toner, photoreceptor and/or blade. However, this method increases the materials complexity and introduces compatibility problems. This often results in films developing on the photoreceptor which hinder photoreceptor function and degrade image quality.

A further proposal for enhancing blade/photoreceptor contact properties is by roughening of the photoreceptor surface to reduce the blade friction and the blade/photoreceptor contact area. This method may also introduce compatibility problems depending on how the roughened surface is introduced. For example, particulate additives to the bulk of the transport layer to provide roughness through surface asperities can degrade electrical and/or mechanical properties. Surface asperities can be worn away in normal machine copying, limiting any cleaning benefit. Surface roughening can also have direct adverse effects such as the introduction of sites against which toner may become lodged. Photoreceptor surface roughening can also inhibit cleaning by allowing the blade to pass over toner and other surface debris.

One of the most common "predictable" or non-random blade cleaning failures is permanent impaction of toner particles and toner fragments. This type of failure is generally encountered and resolved during program development. It involves material, including toner particles, which becomes impacted onto the imaging surface and adheres with such force that the material cannot be removed by the cleaning elements. Additional debris, including untransferred toner residue and developer and/or toner additives, may become jammed against an asperity on the photoreceptor surface. Repeated passes and extended copy can lead to the build-up of elongated crusty deposits in front of the asperity which eventually print out as spots on the copy.

Various strategies have also been implemented or proposed to deal with this type of blade cleaning problem, including those enumerated above. Additional approaches to the resolution of such problems include the elimination of the material which impacts or builds up in the tail, the inclusion of additives which lubricate and/or scavenge the offending material, and the development of an imaging surface which resists toner impaction and/or buildup.

One source of the problem is flat toner particles which adhere tenaciously to the imaging surface. The flat toner particles are difficult to remove from the surface because they do not provide much of a profile to place force upon to remove. Further, the flat toner particles contact the surface over a larger surface area than "spherical" toner particles, thereby increasing the adhesion force of the flat toner particles to the surface. The problem of removing flat toner particles is of particular concern, since some toner compositions may contain about 25% flat toner particles.

Although certain additives may prevent these problems, they are not always successful. Lubricating additives in toner may result in filming. For example, magnesium and zinc stearate additives have problems of filming. This filming may be due to the additives containing flat particles which adhere strongly to the imaging surface. Materials in paper, such as talc, tend to form impacted talc particles which then lead to talc films. Talc also may cause image blurring leading to deletions because talc can absorb water from air rendering it conductive. Aerosil particles, typically about 0.03 micrometer in average diameter, likewise cause cleaning problems such as filming.

Overcoating layers for electrophotographic imaging members have been proposed for a number of different reasons. U.S. Pat. No. 4,764,448 to Yoshitomi et al. discloses an amorphous silicon photoreceptor having a specific surface roughness attained by polishing the surface using soft abrasive substances. The polished surface prevents image blurring in the photoreceptor. The surface has at least one of the following properties: (i) a mean surface roughness along the center line as measured by a needle type surface roughness tester being 190 Angstroms (0.019μ) or less; (ii) a mean surface roughness along the center line as measured by a coordinates measuring scanning electron microscope and a section measuring apparatus being 60 Angstroms (0.006μ) or less; (iii) a variance of mean surface roughness along the center line as measured by a coordinates measuring scanning electron microscope and a section measuring apparatus being 70 Angstroms (0.007μ) or less; (iv) a maximum surface amplitude as measured by a coordinates measuring scanning electron microscope and a section measuring apparatus being 450 Angstroms (0.045μ) or less; and (v) a difference between the mean of five largest values of the surface roughness as measured by a coordinates measuring scanning electron microscope and a section measuring apparatus and the mean of five smallest values of the surface roughness being 420 Angstroms (0.042μ) or less.

U.S. Pat. No. 4,904,557 to Kubo discloses an electrophotographic photosensitive member comprising a photosensitive layer having a surface roughness of ten points over a reference length of 2.5 millimeters. The particular surface roughness is provided to prevent an interference fringe pattern appearing at image formation, and for preventing black dots appearing at reversal development.

U.S. Pat. No. 4,537,849 to Arai discloses a photosensitive element having a roughened selenium-arsenic alloy surface. The outer photoconductive surface is roughened by direct mechanical grinding (polishing). A roughness of less than or equal to 3.0 micrometers laterally and from 0.1 to 2.0 micrometers in height is disclosed for reducing adhesion of transfer paper or toner.

U.S. Pat. Nos. 3,992,091 and 4,076,564 to Fisher disclose roughened imaging surfaces of a xerographic imaging member. Roughening of the photoreceptor surface is achieved indirectly by first chemically etching a substrate. The substrate is then uniformly coated with photoconductive material which conforms to the surface in such a way that the substrate roughness is reproduced on the photoconductive surface. The level of roughness may be from 3 to 5 or 10 to 20 micrometers laterally with a 1 to 2 micrometers height.

U.S. Pat. No. 4,134,763 to Fujimura et al. discloses a method for making the surface of a substrate rougher by bringing a grinding stone in light pressure contact with the surface of the substrate. Small vibrations form a minute roughness on the surface of the substrate. The substrate surface roughness is preferably from 0.3μto 2.0μ. The rough surface of the substrate improves adhesion between the substrate and a selenium layer. Unlike the Fisher patents, the roughness of the substrate is not disclosed as being reproduced in the imaging surface layer.

U.S. Pat. No. 4,804,607 to Atsumi discloses an overcoat layer which is a film-shaped inorganic material coating the surface of a photosensitive layer. The overcoat layer is formed such that a rough surface is provided having 500–3000 convexities and concavities per 1 cm linear distance with a maximum depth difference of 0.05 to 1.5 micrometers between the convexities and the concavities. The convexities and concavities are formed by heating the support, photosensitive layer and the overcoat layer.

U.S. Pat. No. 4,693,951 to Takasu et al. discloses an image bearing member having a maximum (vertical) surface roughness of 20 micrometers or less, and an average surface roughness which is less than or equal to two times a toner particle size. However, nothing about the wavelength between peaks is mentioned.

While the above described imaging members provide a roughened surface for various purposes, the references do not teach or suggest a particular surface roughness which would be desirable for preventing the adhesion of toner particles, and in particular, toner flat particles and additives in the toner which may result in permanent impaction of toner particles and fragments.

SUMMARY OF THE INVENTION

It is an object of the invention to eliminate impaction of toner particles, and in particular, of flat particles in an imaging member.

It is another object of the invention to provide an electrophotographic or electrographic imaging member having improved wear resistance of the exposed layers which maintains the optical and electrical integrities of the layers.

It is also an object of the invention to provide a surface roughness in an exposed layer of an imaging member which prevents the permanent impaction of toner particles and toner fragments.

It is a further object of the invention to provide an imaging member roughness which provides optimum cleaning, especially for allowing the removal of flat particles.

These and other objects of the invention are achieved by providing an imaging member having a particular surface roughness. In one specific embodiment, the surface roughness is defined by $$R/a_{nn}^4 > \frac{K_B(1-\sigma^2)}{32\pi E t^2 a_f}$$

and $$R/a_{nn}^2 < \frac{\sqrt{3}}{8\pi^2}\ \frac{1+\mu^2}{\mu}\ \frac{K_B}{\Gamma}\ \frac{t}{a_f}\ \theta$$

wherein R is an average height of asperities on the surface, $a_{nn}$ is one-half the nearest neighbor distance between asperities, $K_B$ is bulk modulus of a cleaning blade, $\sigma$ is Poisson's ratio of the toner material, E is Young's modulus of the toner material, t is thickness of a flat particle, $a_f$ is an average radius of the flat particles, $\mu$ is an average of toner-blade and toner-imaging member friction coefficients, $\Gamma$ is the Dupré work of adhesion between the surface and the flat particles, and $\theta$ is blade tip angle. The particular surface roughness prevents toner particles from developing high adhesive force on the imaging member surface.

In another embodiment of the invention, the above boundaries defining the surface roughness are further limited to a particular asperity height. The height is chosen such that small particles, such as additives, become easily cleanable by a blade.

BRIEF DESCRIPTION OF THE DRAWINGS

A more complete understanding of the present invention may be obtained by reference to the accompanying drawings wherein.

DESCRIPTION OF PREFERRED EMBODIMENTS

Figure 1:
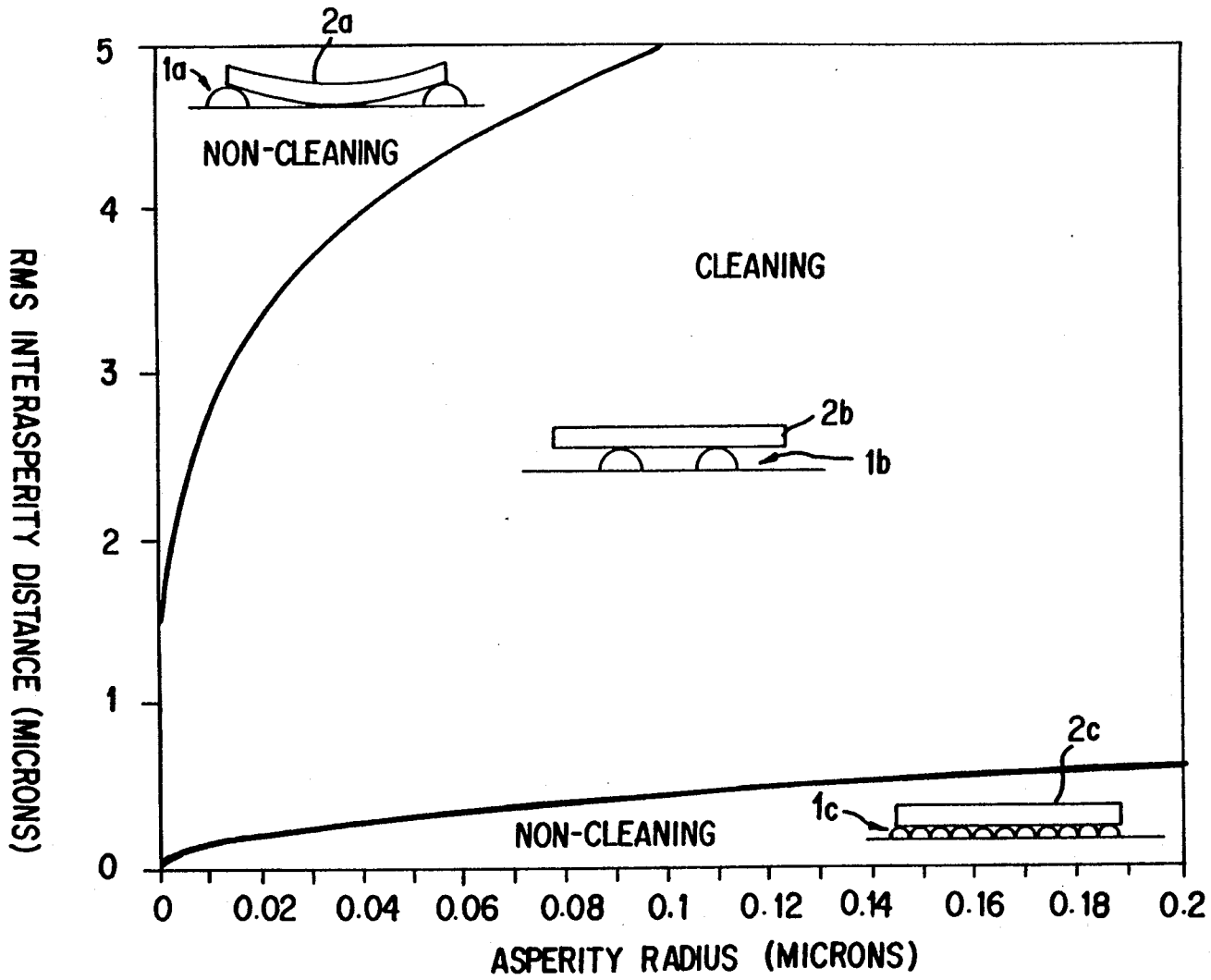
FIG. 1 is a graph of interasperity distance and asperity radius with schematic representations of flat particles on a photoreceptor surface.

The present invention is obtained by providing asperities in the surface of an imaging member having a particular height and spacing which prevents particles, especially flat particles, from developing a high adhesive force which would prevent the particles from being cleaned from the surface. The surface roughness is provided to prevent the particles from locally deforming under blade forces and touching the imaging member over a large surface area.

Unclassified toner particles may range in size from about 1 micrometer to about 25 micrometers in diameter and may have an average diameter of about 9 to about 11 micrometers. Since unclassified toner particles possess a wide range of sizes, the particles become difficult to clean from the imaging member surface. Of particular concern are fine particles in the unclassified toner composition having a diameter of about 1 micrometer or less. One method used to avoid cleaning problems due to the fine particles is classification.

Classification of toner particles is used to eliminate the difficult-to-clean fine particles, resulting in a composition of substantially uniform-sized particles. Although classification permits toner compositions having particles of substantially uniform diameter, a result of the process is an increase in the number of flat toner particles. Classified compositions may contain as much as 25% flat particles. As discussed above, flat particles are difficult to remove because of the small profile and high adhesive force due to the large surface contact area of the flat particles.

The surface roughness of the present invention is provided such that particles, especially flat particles, are unable to develop a high adhesive force which would render the particles difficult to remove.

The topology of the surface of an imaging member may be defined by asperities having a particular height and being spaced from one another by a particular distance. The contact area of a particle, especially a flat particle, is one factor affecting the adhesion of the particle to the imaging member surface. The inventor has determined boundaries for the asperity height and spacing which will prevent the particles from attaining an adhesion force which will prevent the particles from being cleaned from the imaging member.

In one embodiment of the invention, the surface roughness is determined by calculating the boundaries established between:

$$R/a_{nn}^4 > \frac{K_B(1-\sigma^2)}{32\pi E t^2 a_f} \quad (1)$$

and $$R/a_{nn}^2 < \frac{\sqrt{3}}{8\pi^2}\ \frac{1+\mu^2}{\mu}\ \frac{K_B}{\Gamma}\ \frac{t}{a_f}\ \theta \quad (2)$$

wherein R is an average height of asperities (in practice usually roughly hemispherical asperities) on the surface, $a_{nn}$ is one-half the nearest neighbor distance between asperities, $K_B$ is bulk modulus of a cleaning blade, $\sigma$ is Poisson's ratio of the toner, E is Young's modulus of the toner, t is thickness of a flat particle, $a_f$ is a radius of the flat particle, $\mu$ is an average of toner-blade and toner-imaging member friction coefficients, $\Gamma$ is the Dupré work of adhesion between the surface and the flat particle, and $\theta$ is blade tip angle. The Dupré work of adhesion is defined as work per unit area required to separate contacting surfaces.

The following description will, for convenience, be directed to photoreceptor imaging members. However, the invention is not limited thereto, and can also be applied to ionographic and the like imaging members.

FIG. 1 shows the boundaries between non-cleaning conditions and a cleaning condition of a photoreceptor surface in relationship to flat particles. The phase diagram for FIG. 1 is based on cleaning 10 micrometer diameter, one micrometer thick flats from a photoreceptor surface using a blade whose tip angle is 10 degrees. The bulk modulus $K_B$ of the cleaning blade is $10^8$ dynes/cm$^2$; Poisson's ratio $\sigma$ of the toner is 0.33; Young's modulus E of the toner is $1.25\times10^{10}$ dynes/cm$^2$; thickness t of the flat particle is 1 micron; radius $a_f$ of the flat particle is 5 microns; the average of toner-blade and toner-imaging member friction coefficients $\mu$ is 1; and the Dupré work of adhesion $\Gamma$ between the surface and the flat particle is 30 dynes/cm. FIG. 1 schematically shows the condition of a flat particle 2a on a photoreceptor surface 1a. In one non-cleaning condition, the flat particle 2a bends allowing the flat particle to increase its contact area with the photoreceptor surface 1a. Having an increased contact area, the adhesive force of the flat particle adhering to the photoreceptor is increased to a point such that it is extremely difficult for the flat particle 2a to be cleaned from the photoreceptor by a cleaning blade. This can also occur when the photoreceptor surface has a very large number of small asperities dominated by larger asperities 1a.

There is also a region of photoreceptor topography space in which adhesion is dominated by large numbers of asperities making contact with the flat particle. In this case, the total adhesion will be the sum of the adhesion due to each of the flat-asperity contacts. This region is shown as a photoreceptor surface 1c which may be considered as being too rough. A flat particle 2c thus has a high surface energy due to the many contacts with the asperities of the photoreceptor surface 1c. This high surface energy makes it difficult to remove the particle from the surface, and the non-cleaning condition exists.

In a cleaning condition, a photoreceptor surface 1b may be provided which limits the surface contact area of a flat particle 2b. Thus, the flat particle 2b can be cleaned from the surface of the photoreceptor 1b.

The criterion which forms one boundary shown in FIG. 1 for a domain of photoreceptor surface topography in which blade cleaning of flats is possible is given by the equation (1) above. The zone above the boundary of equation (1) defines a region in which flats can conform to widely-spaced surface irregularities, leading to a large adhesion force. Beyond this boundary, asperities are sufficiently close together to prevent large areas of the flat from coming in contact with the smooth photoreceptor surface, thus allowing cleaning of the particles.

The criterion which forms the other boundary shown in FIG. 1 for a domain of photoreceptor surface topology in which blade cleaning of flats is possible is given by equation (2) above. This equation primarily concerns the boundary at which cleaning is possible and at which the surface roughness becomes too "rough", permitting many asperity contact areas with the flat toner particles. The lower region defined by equation (2) has densely packed asperities of uniform height which leads to a large adhesion force. Only in the region between the boundaries defined by equations (1) and (2) is a blade capable of removing flat particles from the photoreceptor surface. The location of both boundaries depends on the blade-tip angle $\theta$.

The blade-tip angle may be set at a particular value, but will oscillate during cleaning due to frictional contact with the photoreceptor surface. For example, the blade may be set at an angle of about 35°, but may oscillate to angles of about 10° or less. It is preferred that this oscillation is non-planing, i.e., the angle does not reach zero degrees, because at such angles cleaning is not possible. In determining the surface roughness, the smallest angle of oscillation is used, for example 10°, for a blade initially set at a 35° angle.

The above terms for equations (1) and (2) may have the following ranges of values for a new (unused) photoreceptor:

$R$=about 0.0025 to about 0.05 micrometer;
$a_{nn}$=about 2.5 to about 7 micrometers;
$K_B$=about $1.0\times10^8$ to about $2.0\times10^8$ dynes/cm$^2$;
$\sigma$=about 0.33 to about 0.38;
$E$=about $1.2\times10^{10}$ to about $3.0\times10^{10}$ dynes/cm$^2$;
$t$=about 1 to about 2 micrometers;
$a_f$=about 4 to about 5 micrometers;
$\mu$=about 0.3 to about 2;
$\Gamma$=about 30 to about 90 dynes/cm.

Many toner compositions contain additives for any of a number of different purposes. Common toner additives include, for example, aerosil. Aerosil is added to toner compositions to act as a flow agent, to control charge of toner particles, etc. Unfortunately, aerosil particles are also a source of cleaning problems in an imaging member. In particular, aerosil particles are very small, and like the flat toner particles, are difficult to remove. The difficulty of removing aerosil particles is due to their small size.

Thus, the addition of additives such as aerosil to toner compositions creates a second factor to be considered in regard to the desired surface topology. In another embodiment of the invention, the removal of fine particles, such as aerosil particles, from the imaging surface is facilitated. In particular, the removal of small diameter particles is permitted in the present invention by limiting the height of the asperities to a maximum of about ½ the diameter of the additive particles. This limitation prevents the particles from becoming lodged between asperities which have a greater height than the particle itself. By limiting the height of the asperities to ½ the diameter of the additive particles, the additive particles will always be exposed to the cleaning blade, and will be able to be removed from the imaging surface.

Aerosil particles may range from about 0.01 micrometer to about 0.05 micrometer in diameter and may be present having an average particle diameter of about 0.03 micrometer. Because of this small size, aerosil particles tend to become difficult to remove from crevices between asperities of a photoreceptor surface. The aerosil particles are able to "hide" from a cleaning blade within the crevices of the imaging member surface. Thus, for example, if aerosil particles are present in the toner composition having an average particle diameter of 0.03 micrometer, the maximum height of the asperities of the present invention should be about 0.015 micrometers. Thus, referring to FIG. 1, the cleaning domain will be defined by the above described equations (1) and (2) defining a cleaning region, but will be further limited to an asperity height R of 0.015 micrometer or less.

The desired surface roughness of the invention may be obtained by any suitable method. For example, the surface roughness may be obtained by varying the drying conditions of a solution coated on the photoreceptor, such as by the methods disclosed in copending U.S. patent application Ser. No. 07/560,876, now abandoned, to Lindblad et al Alternative methods include the inclusion of foreign flat particulate material in the photoreceptor surface, and/or contacting a surface to the photoreceptor surface while it is drying. The particular method utilized must provide the surface roughness of the present invention. The roughness may be provided in an exposed photogenerating layer itself (such as the charge generating layer or the charge transport layer), or may be provided by an additional overcoating layer coated on the imaging member surface.

The surface roughness defined by the invention has been observed in some photoreceptors after they have been exposed to repetitive wear cycles, for example, after about 1000 cycles. It is observed that additives in the toner composition impact on the surface, thereby allowing the photoreceptor to obtain a surface roughness within the cleaning domain defined above. Thus, additive introduced asperities can prevent comet head formation by modifying the roughness of the photoreceptor. Asperities are also introduced onto the photoreceptor surface in the normal course of wear in a machine. Laser profilimetry of the photoreceptor surface shows that a new photoreceptor has areas which lie in both the top non-cleaning zone and the cleaning zone of FIG. 1. The "islands" of non-optimum roughness are sites for potential impaction of flat toner particles. With wear those islands not protected by impacted flat toner particles are destroyed and the surface topography moves into the cleaning zone.

In order to maintain the desired surface roughness, overcoatings can be applied to the roughened surface which are resistant to wear. Alternatively, the rough surface itself may be resistant to wear. For example, nylon overcoats above may be utilized.

Figure 2:
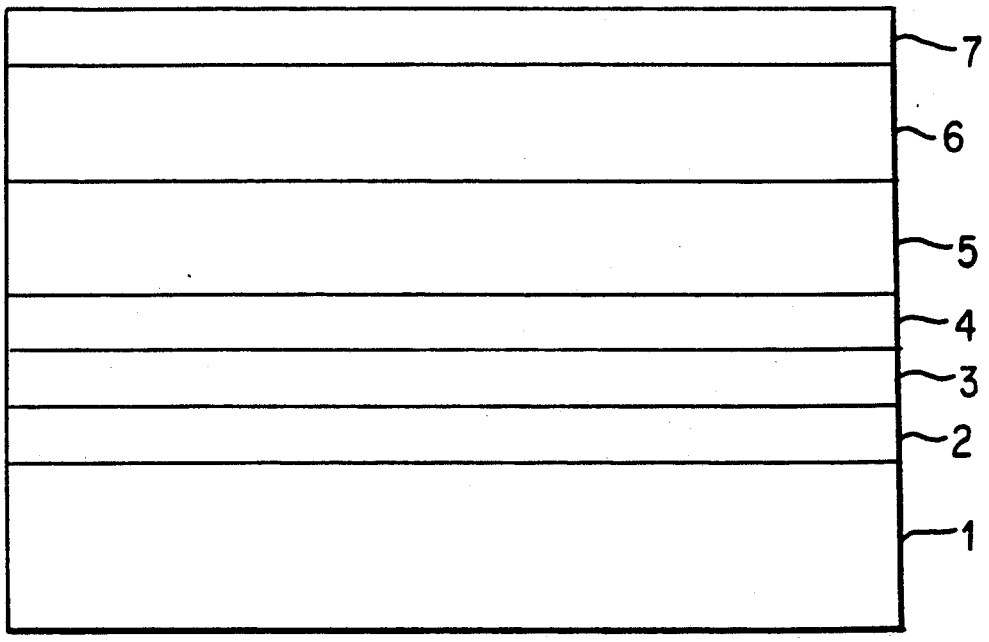
FIG. 2 is a cross-sectional view of a multilayer photoreceptor of the invention.

One type of electrophotographic imaging member is a multilayer imaging member as shown in FIG. 2. This imaging member is provided with a supporting substrate 1, an electrically conductive ground plane 2, a hole blocking layer 3, an adhesive layer 4, a charge generating layer 5, and a charge transport layer 6. An optional overcoating layer having the desired surface roughness of the invention is shown as overcoating layer 7. As discussed above, the surface roughness may be provided directly in the surface of the charge transport layer without the need of the overcoating layer 7. An optional anti-curl layer (not shown) may be provided adjacent the substrate opposite to the imaging layers for preventing curling of the layered imaging member. A description of the layers of the electrophotographic imaging member shown in FIG. 2 follows.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex, available from ICI Americas Inc., or Hostaphan, available from American Hoechst Corporation.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example, less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The electrically conductive ground plane 2 may be an electrically conductive metal layer which may be formed, for example, on the substrate 1 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

After deposition of the electrically conductive ground plane layer, a blocking layer 3 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen-containing siloxanes or nitrogen-containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxy-silane, $[H_2N(CH_2)_3]CH_3Si(OCH_3)_2$, (gamma-aminopropyl) methyl diethoxysilane, as disclosed in U.S. Pat. Nos. 4,338,387, 4,286,033 and 4,291,110. A preferred hole blocking layer comprises a reaction product a hydrolyzed silane or mixture of hydrolyzed silanes and the oxidized surface of a metal ground plane layer. The oxidized surface inherently forms on the outer surface of most metal ground layers when exposed to air after deposition. This combination enhances electrical stability at low RH. The hydrolyzed silanes have the general formula:

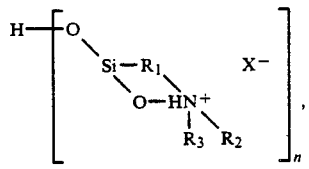

I or

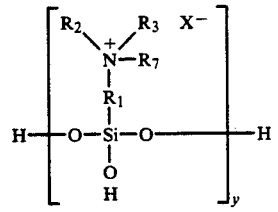

II wherein $R_1$ is an alkylidene group containing 1 to 20 atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

In most cases, intermediate layers between the blocking layer and the adjacent charge generating or photogenerating layer may be desired to promote adhesion. For example, the adhesive layer 4 may be employed. If such layers are utilized, they preferably have a dry thickness between about 0.001 micrometer to about 0.2 micrometer. Typical adhesive layers include film-forming polymers such as polyester, du Pont 49,000 resin (available from E. I. du Pont de Nemours & Co.), Vitel PE-100 (available from Goodyear Rubber & Tire Co.), polyvinylbutyral, polyvinylpyrrolidone, polyurethane, polymethyl methacrylate, and the like.

Any suitable charge generating (photogenerating) layer 5 may be applied to the adhesive layer. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide; and phthalocyanine pigment such as the X-form of metal-free phthalocyanine described in U.S. Pat. No. 3,357,989; metal phthalocyanines such as vanadyl phthalocyanine and copper phthalocyanine; dibromoanthanthrone; squarylium; quinacridones such as those available from du Pont under the tradename Monastral Red, Monastral Violet and Monastral Red Y; dibromo anthanthrone pigments such as those available under the trade names Vat orange 1 and Vat orange 3; benzimidazole perylene; substituted 2,4-diamino-triazines such as those disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infrared light.

Any suitable polymeric film-forming binder material may be employed as the matrix in the photogenerating layer. Typical polymeric film-forming materials include those described, for example, in U.S. Pat. No. 3,121,006. The binder polymer should adhere well to the adhesive layer, dissolve in a solvent which also dissolves the upper surface of the adhesive layer and be miscible with the material of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected, providing the objectives of the present invention are achieved.

Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The charge transport layer 6 may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is normally transparent in a wavelength region in which the photoconductor is to be used when exposure is effected therethrough to ensure that most of the incident radiation is utilized by the underlying charge generating layer. When used with a transparent substrate, imagewise exposure or erasure may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds or charge transport molecules dispersed in normally electrically inactive film-forming polymeric materials for making these materials electrically active. These charge transport molecules may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge-transporting aromatic amine, and about 75 percent to about 25 percent by weight of a polymeric film-forming resin in which the aromatic amine is soluble.

The charge transport layer is preferably formed from a mixture comprising at least one aromatic amine compound of the formula:

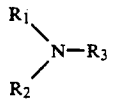

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

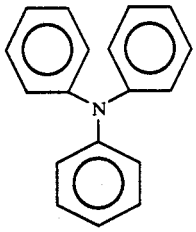

II. Bis and poly triarylamines such as:

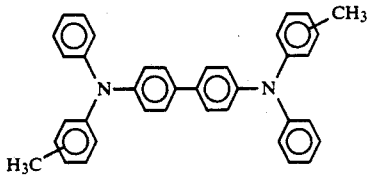

III. Bis arylamine ethers such as:

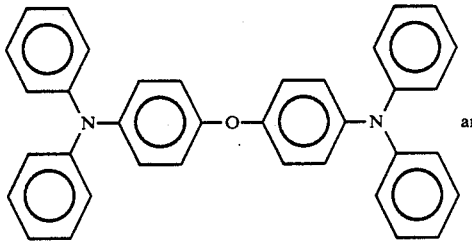

and

IV. Bis alkyl-arylamines such as:

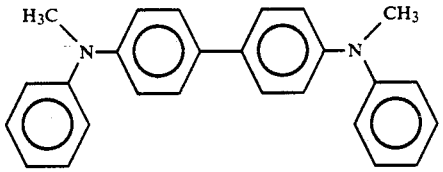

A preferred aromatic amine compound has the general formula:

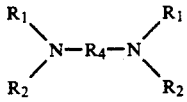

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4,4'-bis(diethylamino)-2,2'-dimethyltriphenylmethane; N,N'-bis(alkylphenyl)-(1,1'-biphenyl)4,4'-diamine wherein the alkyl is, for example, methyl, ethyl, propyl, n-butyl, etc.; N,N'-diphenyl- N,N'-bis(3'-methylphenyl)-(1,1'-biphenyl)-4,4'-diamine; and the like, dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight from about 35,000 to about 40,000, available as Lexan 145 from General Electric Company; poly(4,4'-isopropylidene-diphenylene carbonate) with a molecular weight from about 40,000 to about 45,000 available as Lexan 141 from General Electric Company; a polycarbonate resin having a molecular weight from about 50,000 to about 100,000, available as Makrolon from Farbenfabricken Bayer A. G.; a polycarbonate resin having a molecular weight from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayer photoconductor comprises a charge generating layer comprising a binder layer of photoconductive material and a contiguous hole transport layer of a polycarbonate resin material having a molecular weight of from about 20,000 to about 120,000, having dispersed therein from about 25 to about 75 percent by weight of one or more compounds having the formula:

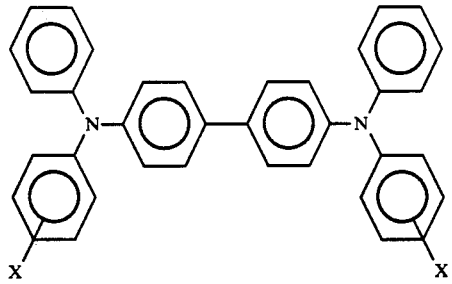

wherein X is selected from the group consisting of an alkyl group, having from 1 to about 4 carbon atoms, and chlorine, the photoconductive layer exhibiting the capability of photogeneration of holes and injection of the holes, the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The desired surface roughness of the invention may be provided on the surface of the charge transport layer. Alternatively, the surface roughness may be provided on the surface of the optional overcoating layer 7. If the optional overcoating layer 7 is provided, it may comprise organic or inorganic polymers that are electrically insulating or slightly semi-conductive.

While the invention has been described with reference to particular preferred embodiments, the invention is not limited to the specific examples given, and other embodiments and modifications can be made by those skilled in the art without departing from the spirit and scope of the invention.

What is claimed is:

1. A system comprising a blade, a toner composition and an unused imaging member, said imaging member comprising a surface to which said toner composition is applied to form a toner image, said surface having a surface roughness defined by $$R/a_{nn}^4 > \frac{K_B(1-\sigma^2)}{32\pi E t^2 a_f}$$

and $$R/a_{nn}^2 < \frac{\sqrt{3}}{8\pi^2}\ \frac{1+\mu^2}{\mu}\ \frac{K_B}{\Gamma}\ \frac{t}{a_f}\ \theta$$

wherein R is an average height of asperities of said surface, $a_{nn}$ is one-half the nearest neighbor distance between said asperities on said surface, $K_B$ is bulk modulus of the blade, $\sigma$ is Poisson's ratio of the toner composition, E is Young's modulus of the toner composition, t is an average thickness of flat particles in said toner composition, $a_f$ is an average radius of the flat particles, $\mu$ is an average of toner-blade and toner-surface friction coefficients, $\Gamma$ is the Dupré work of adhesion between the surface and the flat particles, and $\theta$ is blade tip angle, wherein:

R=about 0.0025 to about 0.05 micrometer;
$a_{nn}$=about 2.5 to about 7 micrometers;
$K_B$=about $1.0\times10^8$ to about $2.0\times10^8$ dynes/cm$^2$;
$\sigma$=about 0.33 to about 0.38;
E=about $1.2\times10^{10}$ to about $3.0\times10^{10}$ dynes/cm$^2$;
t=about 1 to about 2 micrometers;
$a_f$=about 4 to about 5 micrometers;
$\mu$=about 0.3 to about 2; and
$\Gamma$=about 30 to about 90 dynes/cm.

2. The system of claim 1, wherein said blade angle oscillates in a non-planing manner.

3. The system of claim 1, further comprising a protective overcoating layer over said surface which substantially prevents changes in said surface asperities.

4. The system of claim 1, wherein a height of said asperities on said surface is less than about one-half a diameter of a smallest particle in said toner composition.

5. The system of claim 4, wherein said smallest particle ranges from about 0.01 micrometer to about 0.05 micrometer.

6. The system of claim 4, wherein said smallest particle is an additive.

7. The system of claim 4, wherein said smallest particle is an aerosil particle.

8. An imaging process comprising providing an imaging member comprised of at least one photoconductive layer and an imaging surface, forming an electrostatic latent image on said imaging surface, contacting said imaging surface with a developer comprising marking particles whereby said marking particles are deposited on said imaging surface in conformance with said latent image, transferring the deposited marking particles to a receiving member, and cleaning said imaging surface with a blade, said imaging surface being defined by $$R/a_{nn}^4 > \frac{K_B(1-\sigma^2)}{32\pi E t^2 a_f}$$

and $$R/a_{nn}^2 < \frac{\sqrt{3}}{8\pi^2} \frac{1+\mu^2}{\mu} \frac{K_B}{\Gamma} \frac{t}{a_f} \theta$$

wherein R is an average height of asperities of said surface, $a_{nn}$ is one-half the nearest neighbor distance between said asperities on said surface, $K_B$ is bulk modulus of the blade, $\sigma$ is Poisson's ratio of the toner composition, E is Young's modulus of the toner composition, t is an average thickness of flat particles in said toner composition, $a_f$ is an average radius of the flat particles, $\mu$ is an average of toner-blade and toner-surface friction coefficients, $\Gamma$ is the Dupré work of adhesion between the surface and the flat particles, and $\theta$ is blade tip angle, wherein:

R=about 0.0025 to about 0.05 micrometer;
$a_{nn}$=about 2.5 to about 7 micrometers;
$K_B$=about $1.0\times10^8$ to about $2.0\times10^8$ dynes/cm$^2$;
$\sigma$=about 0.33 to about 0.38;
E=about $1.2\times10^{10}$ to about $3.0\times10^{10}$ dynes/cm$^2$;
t=about 1 to about 2 micrometers;
$a_f$=about 4 to about 5 micrometers;
$\mu$=about 0.3 to about 2; and
$\Gamma$=about 30 to about 90 dynes/cm.

9. The imaging process of claim 8, wherein said blade angle oscillates in a non-planing manner.

10. The imaging process of claim 8, wherein there is a protective layer over said surface which substantially prevents changes in said surface asperities.

11. The imaging process of claim 8, wherein a height of the asperities on said surface is less than about one-half a diameter of a smallest particle in said developer.

12. The imaging process of claim 11, wherein a diameter of said smallest particle ranges from about 0.01 micrometer to about 0.05 micrometer.

13. The imaging process of claim 11, wherein said smallest particle is an additive.

14. The imaging process of claim 11, wherein said smallest particle is an aerosil particle.

15. A process for forming an imaging member, comprising:

selecting a toner composition comprising flat particles of an average thickness t and an average radius $a_f$;

selecting a blade having a bulk modulus $K_B$ and a blade tip angle $\theta$ to be applied to a surface of said imaging member;

determining Poisson's ratio $\sigma$ and Young's modulus E of said toner composition;

determining an average $\mu$ of toner-blade and toner-surface friction coefficients;

calculating at least one of and selecting any others of an average height of asperities for said surface, one-half a nearest neighbor distance $a_{nn}$ between said asperities on said surface, and a Dupré work of adhesion $\Gamma$ between the surface and the flat particles to satisfy the formulae:

$$R/a_{nn}^4 > \frac{K_B(1-\sigma^2)}{32\pi E t^2 a_f}$$

and $$R/a_{nn}^2 < \frac{\sqrt{3}}{8\pi^2} \frac{1+\mu^2}{\mu} \frac{K_B}{\Gamma} \frac{t}{a_f} \theta$$

and forming said surface of the imaging member with the above parameters, wherein:

R=about 0.0025 to about 0.05 micrometer;
$a_{nn}$=about 2.5 to about 7 micrometers;
$K_B$=about $1.0\times10^8$ to about $2.0\times10^8$ dynes/cm$^2$;
$\sigma$=about 0.33 to about 0.38;
E=about $1.2\times10^{10}$ to about $3.0\times10^{10}$ dynes/cm$^2$;
t=about 1 to about 2 micrometers;
$a_f$=about 4 to about 5 micrometers;
$\mu$=about 0.3 to about 2; and
$\Gamma$=about 30 to about 90 dynes/cm.

16. The process of claim 15, wherein said blade angle oscillates in a non-planing manner.

17. The process of claim 15, wherein a height of said asperities on said surface is less than about one-half a diameter of a smallest particle in said toner composition.

18. A system comprising a blade, a toner composition and an imaging member, said imaging member comprising a surface to which said toner composition is applied to form a toner image, said surface having a substantially uniform surface roughness defined by $$R/a_{nn}^4 > \frac{K_B(1-\sigma^2)}{32\pi E t^2 a_f}$$

and $$R/a_{nn}^2 < \frac{\sqrt{3}}{8\pi^2} \frac{1+\mu^2}{\mu} \frac{K_B}{\Gamma} \frac{t}{a_f} \theta$$

wherein R is an average height of asperities of said surface, $a_{nn}$ is one-half the nearest neighbor distance between said asperities on said surface, $K_B$ is bulk modulus of the blade, $\sigma$ is Poisson's ratio of the toner composition, E is Young's modulus of the toner composition, t is an average thickness of flat particles in said toner composition, $a_f$ is an average radius of the flat particles, $\mu$ is an average of toner-blade and toner-surface friction coefficients, $\Gamma$ is the Dupré work of adhesion between the surface and the flat particles, and $\theta$ is blade tip angle, wherein:

R=about 0.0025 to about 0.05 micrometer;
$a_{nn}$=about 2.5 to about 7 micrometers;
$K_B$=about $1.0\times10^8$ to about $2.0\times10^8$ dynes/cm$^2$;
$\sigma$=about 0.33 to about 0.38;
E=about $1.2\times10^{10}$ to about $3.0\times10^{10}$ dynes/cm$^2$;
t=about 1 to about 2 micrometers;
$a_f$=about 4 to about 5 micrometers;
$\mu$=about 0.3 to about 2; and
$\Gamma$=about 30 to about 90 dynes/cm.

* * * * *